US009279167B2

(12) United States Patent
Carter

(10) Patent No.: US 9,279,167 B2
(45) Date of Patent: Mar. 8, 2016

(54) METHOD OF FORMING A STAMPED ARTICLE

(75) Inventor: Jon T. Carter, Farmington, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 549 days.

(21) Appl. No.: 13/186,889

(22) Filed: Jul. 20, 2011

(65) Prior Publication Data

US 2013/0020000 A1 Jan. 24, 2013

(51) Int. Cl.

| | |
|---|---|
| ***C21D 9/48*** | (2006.01) |
| ***C21D 8/02*** | (2006.01) |
| ***B21D 22/20*** | (2006.01) |
| ***C21D 1/06*** | (2006.01) |

(52) U.S. Cl.

CPC ..... *C21D 9/48* (2013.01); *B21D 22/208* (2013.01); *C21D 1/06* (2013.01)

(58) Field of Classification Search

CPC ..... C21D 8/02; C21D 9/48
USPC ..... 72/379.2; 148/696, 697, 714
See application file for complete search history.

(56) References Cited

U.S. PATENT DOCUMENTS

| | | | |
|---|---|---|---|
| 6,033,499 | A | 3/2000 | Mitra |
| 7,260,972 | B2 | 8/2007 | Krajewski |
| 2008/0173057 | A1 | 7/2008 | Kruger et al. |

FOREIGN PATENT DOCUMENTS

| | | | |
|---|---|---|---|
| CN | 1554498 | A | 12/2004 |
| CN | 101342556 | A | 1/2009 |
| CN | 101972823 | A | 2/2011 |
| JP | 2011111657 | A | 6/2011 |

OTHER PUBLICATIONS

Theresa M. Lee, Susan E. Hartfield-Wunsch, Siguang Xu, "Demonstration of the Preform Anneal Process to Form a One-Piece Aluminum Door Inner Panel", SAE International, Apr. 2006.

First Office Action of the State Intellectual Property Office of the People's Republic of China for Chinese Patent Application No. 201210253437.7, mailed on Feb. 19, 2014.

*Primary Examiner* — Brian Walck
(74) *Attorney, Agent, or Firm* — Quinn Law Group, PLLC

(57) ABSTRACT

A method of forming an article from a metal alloy sheet material includes selectively hardening only a first localized area of the metal alloy sheet material without hardening a second localized area of the metal alloy sheet material, wherein the second area adjoins the first area to thereby form a blank. The blank has a hardened region formed from the first area and having a first hardness, and a non-hardened region adjoining the hardened region and formed from the second area, and having a second hardness that is less than the first hardness. The method includes stamping the blank to thereby form a preform having a pre-protrusion at least partially formed from the hardened region, wherein the pre-protrusion has a first height, annealing the preform to thereby form a workpiece, and stamping the workpiece to increase the first height and thereby form the article.

16 Claims, 2 Drawing Sheets

METHOD OF FORMING A STAMPED ARTICLE

TECHNICAL FIELD

The present disclosure generally relates to methods of forming metal, and more specifically, to methods of forming an article from a metal alloy sheet material.

BACKGROUND

Automotive sheet metal products, such as body and closure panels, may be formed from metal alloy sheet material at ambient temperature by stamping the metal alloy sheet material into complex shapes. Stamping generally includes gripping the metal alloy sheet material within a stamping tool while a punch forms the metal alloy sheet material according to a shape of a complementary die. Resulting sheet metal products suitable for automotive applications are free from tears and/or metal splitting.

SUMMARY

A method of forming an article from a metal alloy sheet material includes selectively hardening only a first localized area of the metal alloy sheet material without hardening a second localized area of the metal alloy sheet material, wherein the second localized area adjoins the first localized area, to thereby form a blank. The blank has a hardened region formed from the first localized area and having a first thickness, and a non-hardened region adjoining the hardened region and formed from the second localized area, wherein the non-hardened region has a second hardness that is less than the first hardness. The method further includes stamping the blank to thereby form a preform having a pre-protrusion at least partially formed from the hardened region, wherein the pre-protrusion has a first height. In addition, the method includes annealing the preform to thereby form a workpiece, and stamping the workpiece to increase the first height and thereby form the article.

In one embodiment, the method includes selectively hardening only a plurality of first localized areas of the metal alloy sheet material without hardening a plurality of second localized areas of the metal alloy sheet material, wherein each of the plurality of second localized areas adjoins a respective one of the plurality of first localized areas, to thereby form a blank. The blank has a plurality of hardened regions each formed from a respective one of the plurality of first localized areas, wherein each of the plurality of hardened regions has a first hardness. The blank also has a plurality of non-hardened regions each adjoining a respective one of the plurality of hardened regions and formed from a respective one of the plurality of second localized areas, wherein each of the plurality of non-hardened regions has a second hardness that is less than the first hardness. The method further includes stamping the blank to thereby form a preform having a plurality of pre-protrusions each at least partially formed from a respective one of the plurality of hardened regions and having a first height. Concurrent to stamping the blank, the method also includes preferentially inducing greater deformation of the blank at each of the plurality of non-hardened regions than at each of the plurality of hardened regions and thereby increasing the first hardness to a third hardness, and increasing the second hardness to a fourth hardness. After stamping the blank, the method includes annealing the preform to thereby decrease the third hardness and the fourth hardness and form a workpiece. The method further includes stamping the workpiece to elongate both of the plurality of hardened regions and the plurality of non-hardened regions to thereby increase the first height and form the article. The article has a plurality of protrusions each formed from a respective one of the plurality of pre-protrusions and having a second height that is greater than the first height. Concurrent to stamping the workpiece, the method includes preferentially inducing greater deformation of the workpiece at each of the plurality of hardened regions than at each of the plurality of non-hardened regions. Further, each of the plurality of hardened regions cooperates with a respective one of the plurality of non-hardened regions to increase the first height to the second height and thereby form the article.

In another embodiment, the method includes selectively hardening only the plurality of first localized areas without hardening any of the plurality of second localized areas or a remainder of the metal alloy sheet material, wherein the remainder excludes the plurality of first localized areas and the plurality of second localized areas, to thereby form the blank. In addition, the method includes selectively annealing each of the plurality of pre-protrusions without annealing the remainder to thereby form a workpiece.

The above features and other features and advantages of the present disclosure are readily apparent from the following detailed description of the best modes for carrying out the disclosure when taken in connection with the accompanying drawings.

DETAILED DESCRIPTION

Figure 1:
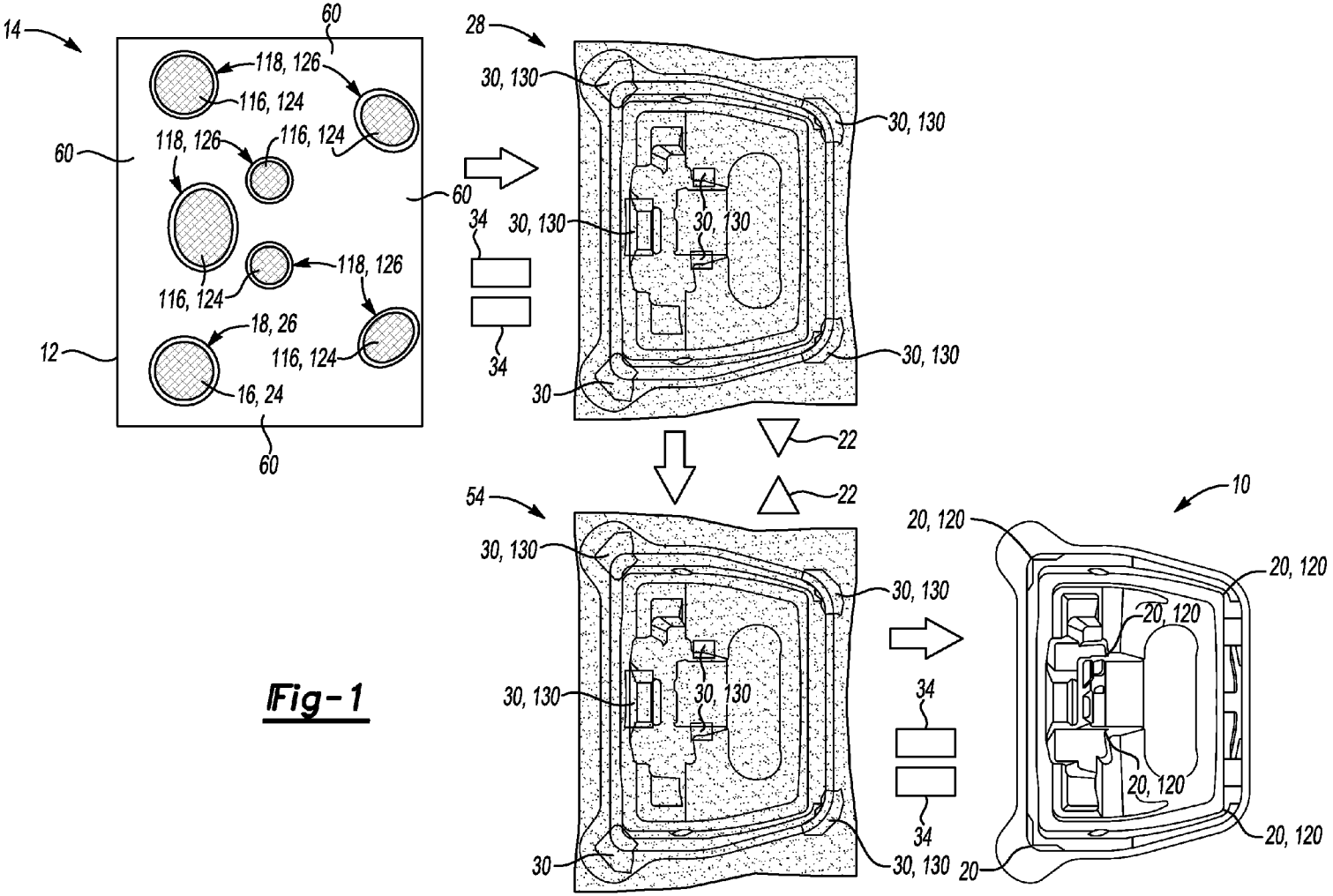
FIG. 1 is a schematic flow diagram of a method of forming an article from a metal alloy sheet material, including a schematic illustration of a blank, preform, workpiece, and article formed by the method.

Referring to the Figures, wherein like reference numerals refer to like elements, a method of forming an article 10 from a metal alloy sheet material 12 is described herein. The method may be useful for forming articles 10 having complex shapes from metal alloy sheet materials 12 such as, but not limited to, aluminum alloys, magnesium alloys, and steel alloys. As such, the method may be useful for forming articles 10 suitable for automotive applications, such as automotive body and closure panels. However, it is to be appreciated that the method may also be useful for forming articles 10 suitable for non-automotive applications, including components for rail and aviation applications.

Figure 2:
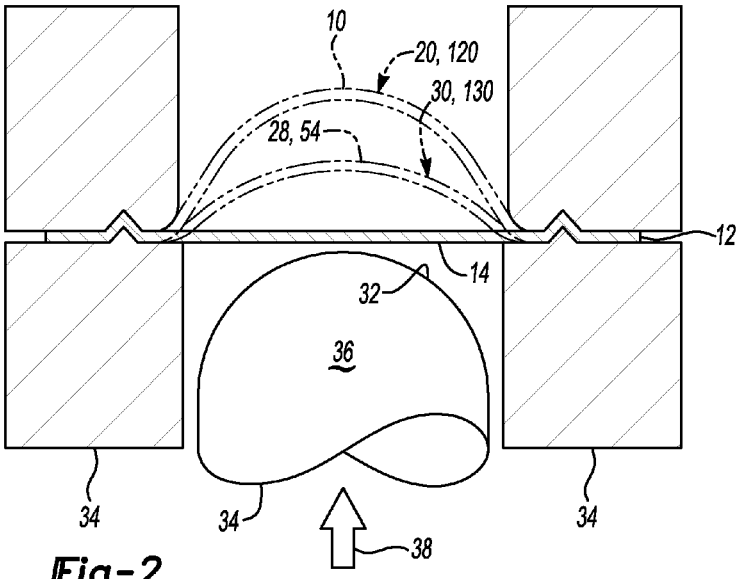
FIG. 2 is a schematic cross-sectional fragmentary illustration of stamping the blank in preparation for forming the article of FIG. 1.

Referring to FIGS. 1 and 2, the method includes stamping a blank 14 formed from the metal alloy sheet material 12, as set forth in more detail below. The metal alloy sheet material 12 may be any metal alloy in sheet form that is suitable for stamping, and may be selected according to the desired application of the article 10 formed by the method.

For example, the metal alloy sheet material 12 may be a strain-hardenable metal alloy in sheet form. As used herein, the terminology "strain-hardenable" refers to a metal alloy that may be strengthened by plastic deformation, e.g., by straining the metal alloy beyond a yield point of the metal alloy.

In one non-limiting example, the metal alloy sheet material 12 may be a 5000 series aluminum alloy in sheet form. The metal alloy sheet material 12 may be strain-hardenable, may be provided in sheet form, and may have a generally hard initial condition. For example, the metal alloy sheet material 12 may be aluminum alloy AA 5182-H19 and have a composition of from about 4.0 parts by weight to about 5.0 parts by weight magnesium, from about 0.20 parts by weight to about 0.50 parts by weight manganese, less than or equal to about 0.20 parts by weight silicon, less than or equal to about 0.10 parts by weight titanium, less than or equal to about 0.15 parts by weight copper, less than or equal to about 0.1 parts by weight chromium, less than or equal to about 0.35 parts by weight iron, less than or equal to about 0.25 parts by weight zinc, and the balance aluminum based on 100 parts by weight of the aluminum alloy AA 5182-H19.

In another non-limiting example, the metal alloy sheet material 12 may be strain-hardenable, may be provided in sheet form, and may have a generally soft initial condition. By way of a non-limiting example, the metal alloy sheet material 12 may be aluminum alloy AA 5182-O and have a composition of from about 4.0 parts by weight to about 5.0 parts by weight magnesium, from about 0.20 parts by weight to about 0.50 parts by weight manganese, less than or equal to about 0.20 parts by weight silicon, less than or equal to about 0.10 parts by weight titanium, less than or equal to about 0.15 parts by weight copper, less than or equal to about 0.1 parts by weight chromium, less than or equal to about 0.35 parts by weight iron, less than or equal to about 0.25 parts by weight zinc, and the balance aluminum based on 100 parts by weight of the aluminum alloy AA 5182-O.

Alternatively, the metal alloy sheet material 12 may be an age-hardenable metal alloy in sheet form. As used herein, the terminology "age-hardenable" refers to a metal alloy that may be strengthened by thermal treatment, e.g., heating the metal alloy to cause a second phase to form within the metal alloy and thereby strengthen the metal alloy.

For example, the metal alloy sheet material 12 may be a 6000 series aluminum alloy in sheet form. The metal alloy sheet material 12 may be age-hardenable, may be provided in sheet form, and may have a generally hard initial condition. By way of a non-limiting example, the metal alloy sheet material 12 may be aluminum alloy AA 6061-T6 and have a composition of from about 0.8 parts by weight to about 1.2 parts by weight magnesium, less than or equal to about 0.15 parts by weight manganese, from about 0.4 parts by weight to about 0.8 parts by weight silicon, from about 0.15 parts by weight to about 0.4 parts by weight copper, less than or equal to about 0.7 parts by weight iron, from about 0.04 parts by weight to about 0.35 parts by weight chromium, less than or equal to about 0.25 parts by weight zinc, less than or equal to about 0.15 parts by weight titanium, and the balance aluminum based on 100 parts by weight of the aluminum alloy AA 6061-T6.

Alternatively, the metal alloy sheet material 12 may be age-hardenable, may be provided in sheet form, and may have a generally soft initial condition. By way of a non-limiting example, the metal alloy sheet material 12 may be aluminum alloy AA 6061-T4 and have a composition of from about 0.8 parts by weight to about 1.2 parts by weight magnesium, less than or equal to about 0.15 parts by weight manganese, from about 0.4 parts by weight to about 0.8 parts by weight silicon, from about 0.15 parts by weight to about 0.4 parts by weight copper, less than or equal to about 0.7 parts by weight iron, from about 0.04 parts by weight to about 0.35 parts by weight chromium, less than or equal to about 0.25 parts by weight zinc, less than or equal to about 0.15 parts by weight titanium, and the balance aluminum based on 100 parts by weight of the aluminum alloy AA 6061-T4.

In yet another non-limiting example, the metal alloy sheet material 12 may be a magnesium alloy in sheet form. For example, the metal alloy sheet material 12 may be magnesium alloy AZ31 and have a composition of about 3 parts by weight aluminum, about 1 part by weight zinc, about 0.2 parts by weight manganese, and the balance magnesium based on 100 parts by weight of the magnesium alloy AZ31.

In another non-limiting example, the metal alloy sheet material 12 may be a steel alloy in sheet form. For example, the metal alloy sheet material 12 may be selected from the group including 4000 series through 9000 series steel alloys, low steel alloys, medium steel alloys, and high-strength low-alloy steel alloys.

Referring again to FIG. 1, the method includes selectively hardening only a first localized area 16 of the metal alloy sheet material 12 without hardening a second localized area 18 of the metal alloy sheet material 12, wherein the second localized area 18 adjoins the first localized area 16, to thereby form the blank 14. For example, the method may further include selecting the first localized area 16 according to a desired location of a stamped feature, e.g., a protrusion 20, on the article 10, as set forth in more detail below. Therefore, the first localized area 16 and the second localized area 18 are localized, i.e., restricted to a particular location on the metal alloy sheet material 12. Further, the first localized area 16 may have any size, shape, or configuration, and the second localized area 18 adjoins the first localized area 16. Therefore, the second localized area 18 may be collocated with the first localized area 16 on the metal alloy sheet material 12, and may immediately surround the first localized area 16.

With continued reference to FIG. 1, as set forth above, the method includes selectively hardening only the first localized area 16 without hardening the second localized area 18. As used herein, the terminology "hardening" refers to increasing a hardness of the metal alloy sheet material 12. Further, selectively hardening refers to localized hardening of the metal alloy sheet material 12, i.e., hardening only the first localized area 16 without hardening the second localized area 18.

The first localized area 16 may be selectively hardened in any manner suitable for hardening only a portion of the metal alloy sheet material 12. By way of a non-limiting example, selectively hardening may include annealing the second localized area 18 without annealing the first localized area 16. As used herein, the terminology "annealing" refers to heat treating the metal alloy sheet material 12, e.g., the first localized area 16 or the second localized area 18, to a pre-determined temperature, maintaining the temperature, and subsequently cooling the metal alloy sheet material 12. For example, the pre-determined temperature may be above the recrystallization temperature of the work-hardened metal alloy sheet material 12. Therefore, for the variation including aluminum alloy AA 5182-H19 or aluminum alloy AA 6061-T6, for example, the method may include annealing the second localized area 18 with a heating element (represented generally and schematically by 22 in FIG. 1) such as, but not limited to, induction coils, hot gas, lasers, heated steel plates, and combinations thereof. Additionally, for this variation, the method may also include cooling the first localized area 16 concurrent to or after annealing the second localized area 18.

In another non-limiting example, selectively hardening may include deforming the first localized area 16 without deforming the second localized area 18. That is, for the variation including aluminum alloy AA 5182-O, for example, the method may include deforming the first localized area 16 by a process selected from the group including shot peening, needle peening, laser peening, roller burnishing, friction processing, reverse oil-canning, and combinations thereof.

As another non-limiting example, selectively hardening may include heating the first localized area 16 without heating the second localized area 18. That is, for the variation including aluminum alloy AA 6061-T4, for example, the method may include heating the first localized area 16 with a heating element (represented generally and schematically by 22 in FIG. 1) such as, but not limited to, induction coils, hot gas, lasers, heated steel plates, and combinations thereof.

Referring again to FIG. 1, the blank 14 formed by selectively hardening only the first localized area 16 has a hardened region 24 formed from the first localized area 16 and having a first hardness, and a non-hardened region 26 adjoining the hardened region 24 and formed from the second localized area 18. The non-hardened region 26 has a second hardness that is less than the first hardness. That is, the non-hardened region 26 is softer than the hardened region 24, and, conversely, the hardened region 24 is harder than the non-hardened region 26. Therefore, the blank 14 has a hard portion and a soft portion, i.e., the hardened region 24 and the non-hardened region 26.

With continued reference to FIG. 1, the method includes stamping the blank 14 to thereby form a preform 28 having a pre-protrusion 30 at least partially formed from the hardened region 24. Therefore, as set forth above, the method may include selecting or identifying the first localized area 16 according to a desired location of the pre-protrusion 30 on the preform 28.

Referring now to FIG. 2, by way of a non-limiting example, stamping may include disposing the blank 14 in contact with a forming surface 32 configured for shaping the blank 14, and stretching the blank 14 along the forming surface 32 to form the pre-protrusion 30. That is, the blank 14 may be stamped with a stamping tool 34 including the forming surface 32.

For example, as shown in FIG. 2, the blank 14 may be stamped with the stamping tool 34 including a punch 36 having the forming surface 32. More specifically, the forming surface 32 may be configured for shaping the blank 14 according to a desired geometry of the article 10. During stamping, the blank 14 may be clamped and/or gripped by the stamping tool 34, and the punch 36 may translate in the direction of arrow 38 to contact the blank 14. It is to be appreciated that the preform 28 (FIGS. 1-3) has an initial shape of the eventual article 10 (FIGS. 1, 2, and 4), but does not have the final shape of the article 10.

Figure 3:
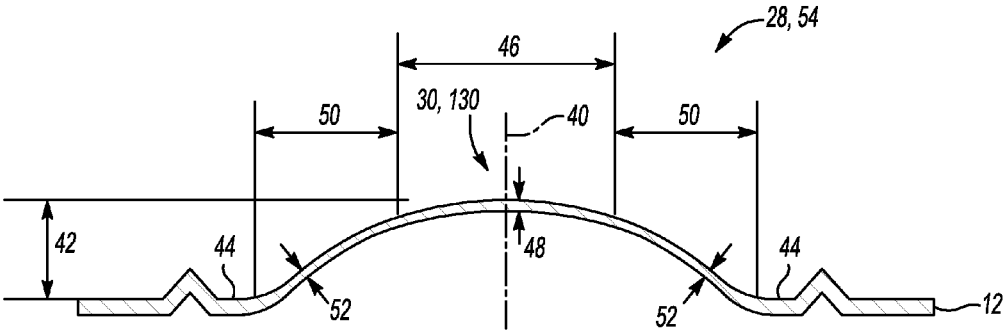
FIG. 3 is a schematic cross-sectional illustration of the preform and workpiece of FIG. 1.

As best shown in FIG. 3, the pre-protrusion 30 may have a longitudinal axis 40 and may protrude from the preform 28 to thereby have a first height 42. More specifically, the pre-protrusion 30 may include a base portion 44, and an apex portion 46 spaced apart from the base portion 44. That is, the apex portion 46 may be spaced apart from the base portion 44 along the longitudinal axis 40. As such, the apex portion 46 may form a top portion of the pre-protrusion 30. The apex portion 46 may be at least partially formed from the hardened region 24 (FIG. 1) of the blank 14 (FIG. 1), and may have a first thickness 48, as shown in FIG. 3. In contrast, the base portion 44 may be at least partially formed from the non-hardened region 26 (FIG. 1) of the blank 14.

In addition, with continued reference to FIG. 3, the pre-protrusion 30 may have a wall portion 50 extending from the base portion 44 so as to interconnect the base portion 44 and the apex portion 46. That is, the wall portion 50 may extend from the base portion 44 between the base portion 44 and the apex portion 46. Therefore, as shown in FIG. 3, the wall portion 50 may form the sides of the pre-protrusion 30. In addition, the wall portion 50 may be at least partially formed from the non-hardened region 26 (FIG. 1), and may have a second thickness 52 that is less than the first thickness 48.

For the method, stamping may further include stretching the hardened region 24 (FIG. 1) of the blank 14 (FIG. 1) in contact with the forming surface 32 (FIG. 2) to form the corresponding apex portion 46 (FIG. 3) of the pre-protrusion 30. Likewise, stamping may also include stretching the non-hardened region 26 (FIG. 1) of the blank 14 in contact with the forming surface 32 to form the corresponding wall portion 50 (FIG. 3) of the pre-protrusion 30. That is, stamping the blank 14 may include stretching the hardened region 24 and the non-hardened region 26 along the forming surface 32 to form the pre-protrusion 30. As the forming surface 32 (FIG. 2) of the punch 36 (FIG. 2) contacts and stretches the blank 14, the non-hardened region 26 (FIG. 1) may stretch more than the hardened region 24 (FIG. 1). As such, the wall portion 50 may be thinner than the apex portion 46, as set forth above.

With continued reference to FIGS. 1 and 3, after selectively hardening, the hardened region 24 (FIG. 1) has the first hardness and the non-hardened region 26 (FIG. 1) has the second hardness that is less than the first hardness, as set forth above. Therefore, concurrent to stamping the blank 14 (FIG. 1), the method may also include preferentially inducing greater deformation of the blank 14 at the non-hardened region 26 than at the hardened region 24. That is, since the second hardness of the non-hardened region 26 is less than the first hardness of the hardened region 24, i.e., since the non-hardened region 26 is softer than the hardened region 24, the non-hardened region 26 may preferentially deform more than the hardened region 24 during stamping of the blank 14. Conversely, the hardened region 24 may deform less than the non-hardened region 26 during stamping of the blank 14.

Accordingly, the non-hardened region 26 (FIG. 1) may elongate or stretch along the forming surface 32 (FIG. 2) comparatively more than the hardened region 24 (FIG. 1). Therefore, the hardened region 24 may have a maximized localized thickness, i.e., the first thickness 48, after stamping the blank 14 (FIG. 1). That is, after stamping the blank 14, the hardened region 24, e.g., the apex portion 46, may be thicker than the non-hardened region 26, e.g., the wall portion 50, as illustrated schematically in FIG. 3. Stated differently, during stamping of the blank 14, the metal alloy sheet material 12 of the non-hardened region 26 may participate to a comparatively greater degree than the metal alloy sheet material 12 of the hardened region 24 in the formation of the pre-protrusion 30.

With continued reference to FIGS. 1 and 2, the method may further include, concurrent to stamping the blank 14, increasing the first hardness to a third hardness, and increasing the second hardness to a fourth hardness. That is, the method may include, concurrent to stamping the blank 14, straining the hardened region 24 (FIG. 1) so as to increase the first hardness to the third hardness. Similarly, the method may include, concurrent to stamping, straining the non-hardened region 26 (FIG. 1) so as to increase the second hardness to the fourth hardness. Stated differently, the method may include work-hardening the hardened region 24 and the non-hardened region 26 during stamping of the blank 14, i.e., stretching the hardened region 24 and non-hardened region 26 of the blank 14 along the forming surface 32 (FIG. 2) of the punch 36 (FIG. 2).

Referring again to FIG. 1, after stamping the blank 14, the method includes annealing the preform 28 to thereby form a workpiece 54. The preform 28 may be annealed in any manner suitable for heating the preform 28. For example, annealing may include heating the preform 28 to a temperature of from about 250° C. to about 550° C. The temperature may be selected, for example, according to the alloy composition of the metal alloy sheet material 12 and an amount of work-hardening of the blank 14. In one non-limiting example, annealing may include induction heating the preform 28 to a temperature of from about 300° C. to about 500° C. for a duration of from about 5 seconds to about 1 minute. That is, annealing may include induction heating the preform 28 with a plurality of localized heating elements 22 to a temperature of from about 300° C. to about 400° C. for a duration of from about 5 seconds to about 30 seconds. Further, although the plurality of localized heating elements 22 is schematically shown disposed external the preform 28 in FIG. 1, it is to be appreciated that the localized heating elements 22 may be positioned immediately adjacent (not shown) to the preform 28, e.g., adjacent to the pre-protrusion 30.

Therefore, after stamping the blank 14, the method may further include decreasing the third hardness. That is, without intending to be limited by theory and described with reference to FIGS. 1 and 3, the hardened region 24 (FIG. 1) may be thicker than the non-hardened region 26 (FIG. 1) after stamping the blank 14 to form the preform 28 (FIG. 1), as set forth above. Annealing the preform 28 may then soften the hardened region 24 and the non-hardened region 26. That is, annealing the preform 28 may relieve internal stresses within the metal alloy sheet material 12 generated during stamping the blank 14, and may improve the formability of the hardened region 24. Therefore, annealing the preform 28 may decrease the third hardness.

After annealing, the method may further include quenching the workpiece 54 (FIG. 1) to about ambient temperature. That is, the workpiece 54 may be cooled after annealing the preform 28 (FIG. 1). Such quenching may protect the stamping tool 34 (FIG. 2) from heat generated during annealing.

Figure 4:
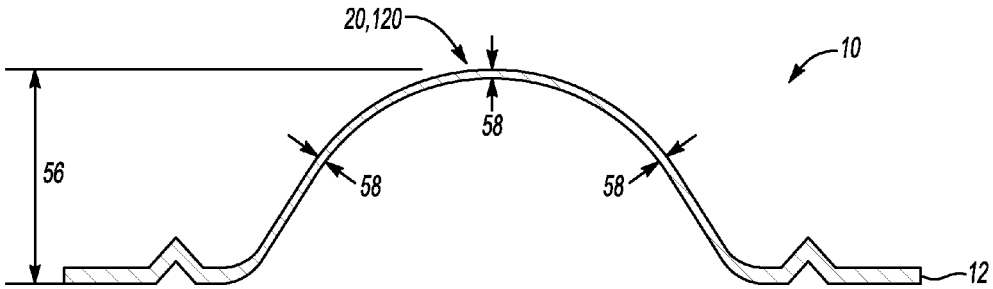
FIG. 4 is a schematic cross-sectional illustration of the article of FIG. 1.

Referring now to FIGS. 1-4, after annealing and optional quenching, the method further includes stamping the workpiece 54 (FIG. 1) to increase the first height 42 (FIG. 3) to thereby form the article 10 (FIG. 4). That is, as shown in FIGS. 1 and 4, the article 10 may have the protrusion 20 formed from the pre-protrusion 30 (FIG. 3) and having a second height 56 (FIG. 4) that is greater than the first height 42 (FIG. 3) of the pre-protrusion 30. Therefore, stamping the workpiece 54 increases the first height 42 of the pre-protrusion 30 and thereby forms the article 10.

Concurrent to stamping the workpiece 54 (FIG. 3), therefore, the method may further include, preferentially inducing greater deformation of the workpiece 54 at the hardened region 24 (FIG. 1) than at the non-hardened region 26 (FIG. 1). That is, as set forth above, both of the hardened region 24 and non-hardened region 26 may be softened during annealing of the preform 28. However, as also set forth above, the hardened region 24 may be thicker than the non-hardened region 26 after formation of the workpiece 54. Therefore, without intending to be limited by theory, the hardened region 24 may preferentially deform, e.g., stretch or elongate, more than the non-hardened region 26 during stamping of the workpiece 54.

That is, the hardened region 24 may elongate or stretch along the forming surface 32 (FIG. 2) comparatively more than the non-hardened region 26 during stamping of the workpiece 54. Stated differently, the hardened region 24 may have a maximized localized thickness, i.e., the first thickness 48 (FIG. 3), after stamping the blank 14 (FIG. 1) to form the preform 28 (FIG. 3). Therefore, after annealing the preform 28 to form the workpiece 54, the hardened region 24 may still be comparatively thicker than the non-hardened region 26. As such, comparatively more of the metal alloy sheet material 12 may be concentrated at the hardened region 24 than at the non-hardened region 26 so that the hardened region 24 may participate to a comparatively greater degree in the formation of the protrusion 20 than the non-hardened region 26.

The hardened region 24 and the non-hardened region 26 may cooperate to increase the first height 42 (FIG. 3) and thereby form the article 10 (FIG. 4). That is, stamping the workpiece 54 (FIG. 3) may include elongating both of the hardened region 24 (FIG. 1) and the non-hardened region 26 (FIG. 3) to increase the first height 42 (FIG. 3) Annealing the preform 28 may restore ductility to the workpiece 54 so that each of the hardened region 24 and non-hardened region 26 may contribute to the formation of the protrusion 20. However, since the hardened region 24 is comparatively thicker than the non-hardened region 26 after stamping the blank 14 to form the preform 28, comparatively more of the metal alloy sheet material 12 at the hardened region 24 is available as compared to the metal alloy sheet material 12 of the non-hardened region 26 for increasing the first height 42.

As such, with continued reference to FIGS. 3 and 4, the method may further include concurrently increasing the first height 42 (FIG. 3) and minimizing localized tearing of the workpiece 54 (FIG. 3) at the pre-protrusion 30 (FIG. 3). That is, the method minimizes localized thinning and/or splitting of the article 10 during forming. Therefore, the total maximum height, i.e., the second height 56 (FIG. 4), of the article 10 (FIG. 4) is greater than the first height 42 (FIG. 3) of the preform 28 (FIG. 3), and the article 10 does not tear and/or split during forming.

Referring again to FIGS. 1-4, the workpiece 54 (FIG. 3) may be stretched along the forming surface 32 (FIG. 2) of the stamping tool 34 (FIG. 2) to increase the first height 42 (FIG. 3) of the pre-protrusion 30 (FIG. 3) and concurrently substantially equalize the thickness 58 (FIG. 4) of the hardened region 24 and the non-hardened region 26. That is, stamping the workpiece 54 may form the article 10 (FIG. 4) having a substantially uniform thickness 58 (FIG. 4) at each of the hardened region 24 (FIG. 1) and the non-hardened region 26 (FIG. 1), i.e., at the protrusion 20, of from about 0.75 mm to about 2.25 mm.

Referring again to FIG. 1, in another embodiment of the method, the method includes selectively hardening a plurality of first localized areas 16, 116 of the metal alloy sheet material 12 without hardening a plurality of second localized areas 18, 118 of the metal alloy sheet material 12, wherein each of the plurality of second localized areas 18, 118 adjoins a respective one of the plurality of first localized areas 16, 116, to thereby form the blank 14. That is, each of the first localized areas 16, 116 may adjoin or abut a respective one of the second localized areas 18, 118. The plurality of first localized areas 16, 116 may correspond to a desired location of a plurality of protrusions 20, 120 of the finished article 10, as set forth in more detail below. Therefore, the method may be useful for forming articles 10 having multiple complex protrusions 20, 120 and/or shapes.

In this embodiment, as set forth above, the method includes selectively hardening only the plurality of first localized areas 16, 116 without hardening the plurality of second localized areas 18, 118. Therefore, as shown in FIG. 1, the blank 14 has a plurality of hardened regions 24, 124 each formed from a respective one of the plurality of first localized areas 16, 116, wherein each of the plurality of hardened regions 24, 124 has the first hardness. In addition, the blank 14 has a plurality of non-hardened regions 26, 126 each adjoining a respective one of the plurality of hardened regions 24, 124 and formed from a respective one of the plurality of second localized areas 18, 118, wherein each of the plurality of non-hardened regions 26, 126 has the second hardness that is less than the first hardness.

With continued reference to FIG. 1, the method further includes stamping the blank 14 to thereby form the preform 28 having a plurality of pre-protrusions 30, 130 each at least partially formed from a respective one of the plurality of hardened regions 24, 124, wherein each of the plurality of pre-protrusions 30, 130 has the first height 42 (FIG. 3).

In this embodiment, concurrent to stamping the blank 14, the method includes preferentially inducing greater deformation of the blank 14 at each of the plurality of non-hardened regions 26, 126 than at each of the plurality of hardened regions 24, 124 and thereby increasing the first hardness to the third hardness, and increasing the second hardness to the fourth hardness. After stamping the blank 14, the method includes annealing the preform 28 to thereby decrease the third hardness and the fourth hardness and form the workpiece 54.

In addition, referring again to FIG. 1, in this embodiment, the method also includes stamping the workpiece 54 to elongate both of the plurality of hardened regions 24, 124 and the plurality of non-hardened regions 26, 126 to thereby increase the first height 42 (FIG. 3) and form the article 10. The article 10 has a plurality of protrusions 20, 120 each formed from a respective one of the plurality of pre-protrusions 30, 130 and having the second height 56 (FIG. 4) that is greater than the first height 42 (FIG. 3). Concurrent to stamping the workpiece 54, the method includes preferentially inducing greater deformation of the workpiece 54 at each of the plurality of hardened regions 24, 124 than at each of the plurality of non-hardened regions 26, 126. Each of the plurality of hardened regions 24, 124 cooperates with a respective one of the plurality of non-hardened regions 26, 126 to increase the first height 42 to the second height 56 and thereby form the article 10. More specifically, stamping the workpiece 54 may form the article 10 having the substantially uniform thickness 58 (FIG. 4) of from about 0.75 mm to about 2.25 mm at each of the plurality of protrusions 20, 120.

In yet another embodiment of the method, as also described with reference to FIG. 1, the method includes selectively hardening only the plurality of first localized areas 16, 116 of the metal alloy sheet material 12 without hardening any of the plurality of second localized areas 18, 118 of the metal alloy sheet material 12, wherein each of the plurality of second localized areas 18, 118 adjoins a respective one of the plurality of first localized areas 16, 116, or a remainder 60 of the metal alloy sheet material 12, wherein the remainder 60 excludes the plurality of first localized areas 16, 116 and the plurality of second localized areas 18, 118, to thereby form the blank 14. That is, the remainder 60 excludes the plurality of first localized areas 16, 116 and the plurality of second localized areas 18, 118. Therefore, for this embodiment, the method includes selectively hardening only the plurality of first localized areas 16, 116 without hardening any of the plurality of second localized areas 18, 118 or the remainder 60 to thereby form the blank 14.

For this embodiment, the method also includes stamping the blank 14 to thereby form the preform 28 having the plurality of pre-protrusions 30, 130, as set forth above. However, in addition, before stamping the workpiece 54 to increase the first height 42 (FIG. 3) and thereby form the article 10, the method includes selectively annealing each of the plurality of pre-protrusions 30, 130 without annealing the remainder 60 to thereby form the workpiece 54. As used herein, selectively annealing refers to localized annealing, i.e., annealing only the plurality of pre-protrusions 30, 130 without annealing the remainder 60, to thereby form the workpiece 54. As such, the plurality of pre-protrusions 30, 130 may be selectively annealed in any manner suitable for heating only a portion of the metal alloy sheet material 12. Selectively annealing may include heating each of the plurality of pre-protrusions 30, 130 to a temperature of from about 250° C. to about 550° C., e.g., to a temperature of from about 300° C. to about 500° C. for a duration of from about 5 seconds to about 1 minute. That is, selectively annealing may include induction heating each of the plurality of pre-protrusions 30, 130 with a respective plurality of localized heating elements 22 (FIG. 1) to a temperature of from about 300° C. to about 400° C. for a duration of from about 5 seconds to about 30 seconds. As such, this embodiment of the method requires comparatively lower heating energy during selective annealing and is therefore cost-effective as compared to a comparative method including annealing the entire preform 28.

Therefore, the method maximizes the formability of the metal alloy sheet material 12. In particular, the method forms articles 10 having increased shape complexity and allows for protrusions 20, 120 having an increased total height, i.e., second height 56 (FIG. 4), without splitting. That is, the method minimizes localized thinning and/or splitting of articles 10 during forming. Therefore, the total height, i.e., second height 56, of the article 10 is greater than the first height 42 (FIG. 3) of the preform 28 (FIG. 3), and the article 10 does not tear and/or split during forming. Further, the total height, i.e., the second height 56, of the article 10 is greater than a total maximum height (not shown) of comparative articles (not shown) formed, for example, without any hardening and/or without selectively hardening the first localized area 16, i.e., hardening the entire comparative preform (not shown) and/or selectively hardening only the second localized area 18.

In addition, the method is suitable for both age-hardenable metal alloy sheet materials 12 and strain-hardenable metal alloy sheet materials 12. Further, the method forms articles 10 having protrusions 20, 120 having excellent uniformity of thickness 58 (FIG. 4) at the hardened region 24, 124 and the non-hardened region 26, 126. That is, as shown in FIG. 4, the formed article 10 has the substantially uniform thickness 58 at each of the hardened region 24, 124 and the non-hardened region 26, 126. In addition, the method is cost-effective as compared to a comparative method including hardening an entire comparative preform (not shown). As such, the method may be useful for forming complex articles 10 such as decklid and liftgate panels for automotive vehicles.

While the best modes for carrying out the disclosure have been described in detail, those familiar with the art to which this disclosure relates will recognize various alternative designs and embodiments for practicing the disclosure within the scope of the appended claims.

The invention claimed is:

1. A method of forming an article from a metal alloy sheet material, the method comprising:

selectively hardening only a first localized area of the metal alloy sheet material without hardening a second localized area of the metal alloy sheet material, wherein the second localized area adjoins the first localized area, to thereby form a blank having;

a hardened region formed from the first localized area and having a first hardness; and a non-hardened region adjoining the hardened region and formed from the second localized area, wherein the non-hardened region has a second hardness that is less than the first hardness;

stamping the blank to thereby form a preform having a pre-protrusion, wherein the pre-protrusion is formed from both the hardened region and the non-hardened region and has:

a longitudinal axis;

a base portion formed from the non-hardened region;

an apex portion spaced apart from the base portion along the longitudinal axis and having a first thickness, wherein the apex portion is formed from the hardened region;

a wall portion extending from the base portion so as to interconnect the base portion and the apex portion, wherein the wall portion has a second thickness that is less than the first thickness and is formed from the non-hardened region; and a first height along the longitudinal axis;

annealing the preform to thereby form a workpiece; and stamping the workpiece to elongate both the apex portion and the wall portion to increase the first height along the longitudinal axis, substantially equalize the first thickness and the second thickness, and thereby form the article.

2. The method of claim 1, further including, concurrent to stamping the blank, preferentially inducing greater deformation of the blank at the non-hardened region than at the hardened region.

3. The method of claim 1, further including, concurrent to stamping the workpiece, preferentially inducing greater deformation of the workpiece at the hardened region than at the non-hardened region.

4. The method of claim 1, further including, concurrently increasing the first height and minimizing localized tearing of the workpiece at the pre-protrusion.

5. The method of claim 1, further including, concurrent to stamping the blank, increasing the first hardness to a third hardness, and increasing the second hardness to a fourth hardness.

6. The method of claim 5, further including, after stamping the blank, decreasing the third hardness.

7. The method of claim 1, wherein the preform includes comparatively more of the metal alloy sheet material at the hardened region than at the non-hardened region such that stamping the workpiece stretches the metal alloy sheet material at the hardened region to increase the first height and thereby form the article.

8. The method of claim 1, further including selecting the first localized area according to a desired location of the pre-protrusion on the preform.

9. The method of claim 1, wherein selectively hardening includes annealing the second localized area without annealing the first localized area.

10. The method of claim 1, wherein selectively hardening includes deforming the first localized area without deforming the second localized area.

11. The method of claim 1, wherein selectively hardening includes heating the first localized area without heating the second localized area.

12. The method of claim 1, wherein annealing includes heating the preform to a temperature of from about 250° C. to about 550° C.

13. The method of claim 1, wherein the metal alloy sheet material is an age-hardenable metal alloy in sheet form.

14. The method of claim 1, wherein the metal alloy sheet material is a strain-hardenable metal alloy in sheet form.

15. A method of forming an article from a metal alloy sheet material, the method comprising:

selectively hardening only a plurality of first localized areas of the metal alloy sheet material without hardening a plurality of second localized areas of the metal alloy sheet material, wherein each of the plurality of second localized areas adjoins a respective one of the plurality of first localized areas, to thereby form a blank having;

a plurality of hardened regions each formed from a respective one of the plurality of first localized areas, wherein each of the plurality of hardened regions has a first hardness; and a plurality of non-hardened regions each adjoining a respective one of the plurality of hardened regions and formed from a respective one of the plurality of second localized areas, wherein each of the plurality of non-hardened regions has a second hardness that is less than the first hardness;

stamping the blank to thereby form a preform having a plurality of pre-protrusions each formed from both a respective one of the plurality of hardened regions and a respective one of the plurality of non-hardened regions, wherein each of the plurality of pre-protrusions has:

a longitudinal axis;

a base portion formed from the respective one of the plurality of non-hardened regions;

an apex portion spaced apart from the base portion along the longitudinal axis and having a first thickness, wherein the apex portion is formed from the respective one of the plurality of hardened regions;

a wall portion extending from the base portion so as to interconnect the base portion and the apex portion, wherein the wall portion has a second thickness that is less than the first thickness and is formed from the respective one of the plurality of non-hardened regions; and a first height along the longitudinal axis;

concurrent to stamping the blank, preferentially inducing greater deformation of the blank at each of the plurality of non-hardened regions than at each of the plurality of hardened regions and thereby increasing the first hardness to a third hardness, and increasing the second hardness to a fourth hardness;

after stamping the blank, annealing the preform to thereby decrease the third hardness and the fourth hardness and form a workpiece;

stamping the workpiece to elongate both of the apex portion and the wall portion of each of the plurality of pre-protrusions to thereby increase the first height along the longitudinal axis, substantially equalize the first thickness and the second thickness, and form the article, wherein the article has a plurality of protrusions each formed from a respective one of the plurality of pre-protrusions and having a second height that is greater than the first height; and concurrent to stamping the workpiece, preferentially inducing greater deformation of the workpiece at the apex portion of each of the plurality of pre-protrusions than at the wall portion of each of the plurality of pre-protrusions, wherein the apex portion of each of the plurality of pre-protrusions is comparatively thicker than the wall portion of each of the plurality of pre-protrusions after stamping the blank so that the preform includes comparatively more of the metal alloy sheet material at the apex portion of each of the plurality of pre-protrusions than at the wall portion of each of the plurality of pre-protrusions such that stamping the workpiece stretches the metal alloy sheet material at the apex portion of each of the plurality of pre-protrusions to increase the first height to the second height and thereby form the article.

16. The method of claim 15, wherein stamping the workpiece forms the article having a substantially uniform thickness of from about 0.75 mm to about 2.25 mm at each of the plurality of protrusions.

* * * * *